US007491158B1

(12) United States Patent
Danaei-Boroumand

(10) Patent No.: US 7,491,158 B1
(45) Date of Patent: Feb. 17, 2009

(54) UPPER EXTREMITY AND SPINAL EXERCISE APPARATUS

(76) Inventor: Shahram Danaei-Boroumand, 522 Almer Rd. #2, Burlingame, CA (US) 94010

( * ) Notice: Subject to any disclaimer, the term of this patent is extended or adjusted under 35 U.S.C. 154(b) by 85 days.

(21) Appl. No.: 11/317,828

(22) Filed: Dec. 24, 2005

(51) Int. Cl.
*A63B 21/22* (2006.01)
*A63B 21/012* (2006.01)

(52) U.S. Cl. ..... 482/110; 482/114; 482/115

(58) Field of Classification Search ..... 482/92, 482/114–116, 118, 119, 121–123, 129–131, 482/133–139, 905
See application file for complete search history.

(56) References Cited

U.S. PATENT DOCUMENTS 4,603,856 A 8/1986 Fiore
4,772,015 A 9/1988 Carlson
4,850,586 A 7/1989 Horvath
5,713,823 A 2/1998 Walendzak
5,813,956 A 9/1998 Iams
6,186,930 B1 * 2/2001 Ignaczak ..... 482/141
6,450,928 B1 9/2002 Larkins
6,689,030 B1 2/2004 Leslie
7,108,643 B2 * 9/2006 Wilson et al. ..... 482/141
7,115,078 B1 * 10/2006 Kalember et al. ..... 482/117

* cited by examiner

*Primary Examiner*—Glenn Richman

(57) ABSTRACT

A mechanical exercise apparatus for exercising upper extremities, as well as promoting and affecting the natural spinal motions and core stabilization, which relates to the shoulder complex, includes a base to provide stability; a rotator device that is attached to the upper surface of the base; a handle device that is mounted at the rotator device that is slideable; an oval device for repositioning the handle device that is placed in a track fixed in a groove on the upper surface of the base.

2 Claims, 10 Drawing Sheets

UPPER EXTREMITY AND SPINAL EXERCISE APPARATUS

CROSS-REFERENCE TO RELATED APPLICATIONS

Not Applicable

FEDERALLY SPONSORED RESEARCH

Not Applicable

SEQUENCE LISTING OR PROGRAM

Not Applicable

BACKGROUND OF THE INVENTION

1. Field of Invention

This invention relates to a therapy and training device to improve strength, flexibility, physical rehabilitation and neuromuscular reeducation of upper extremities, as well as to promote physiological motion in the thoracoscapula joints, affecting the natural spinal motions and core stabilization, which relate to the shoulder complex.

2. Prior Arts

People who have undergone any type of shoulder-arm surgeries suffer under many symptoms that limit their functional activities. Therapists and trainers eagerly search for a device that can help the client during their supervision and at home, while the client is not under professional assistant or therapy.

Over the years, numerous of different exercise machines have been developed to improve the pathological condition in the shoulder region and help the patients with recovery.

However, many of these equipments are built in complexities that require the professional supervision of a therapist or a trainer. For example, U.S. Pat. No. 4,850,586, issued to Horvath, discloses a complicated exercise equipment, involving a "tower" that is a combination of frame, which are attached to the "bench" and are independently rotatable.

Not only that most of the exercise equipments require supervision, they are costly and for many people not affordable. U.S. Pat. No. 4,850,586, issued to Horvath, is a great example.

Space is another big issue by the most home exercise machines. Many of them require a big space to be placed and stored. U.S. Pat. No. 4,988,098, issued to Miller, is another machine that uses a multipart weight and pulley system requiring big space for training.

Addition to disadvantages mentioned above, U.S. Pat. No. 4,850,586, issued to Horvath, demonstrates more weaknesses.

a—The device is very heavy and not practical for transportation. It is not portable.

b—The rotor base allows only a circular motion and reduces the scapulothoracal motion.

c—Due to the rotor base being fixed in a horizontal plane, the rotor base allows the user only a horizontal motion and limits the sagittal and frontal movements in shoulder completely.

U.S. Pat. No. 5,713,823, issued to Walendzak and Millar, is a device that is set together from a round frame, a support member with a pivot ball mounted on the underside of the support member at the center of the round frame. This device demonstrates a primitive form of an exercise machine that demonstrates following disadvantages:

a—The device is not stable during active use.

b—The device is used only in a horizontal plain. It limits the user in a horizontal motion of the shoulder and does not promote the sagittal and frontal motion.

c—The complicated adjustment of different grips and pivoting balls to change the difficulty of the exercises make the device hard to use for an independent user.

d—To increase the difficulty of the exercise is the increase of the weight bearing position required. This forces the user to perform the exercise in a kneeling position on the floor, which is restricting the users with knees, hips, spine and neck issues.

OBJECTS AND ADVANTAGES

Accordingly, several objects and advantages of present invention are:

a—to provide a simple device and easy to use home exercises machine that does not require a continual professional assistant.

b—to provide a cost effective device that is affordable.

c—to provide a compact, light, and portable device that is easy to store if needed.

d—to provide a device with a unique system that promotes the scapulothoracal motion.

e—to provide a device that allows all three important shoulder motions-frontal, horizontal, and sagittal.

f—to provide a device that has a simple resistance adjustability.

g—to provide a device that will not limit users with additional muscle or joint problems to utilize the exercise apparatus.

h—to provide a device that promotes spinal motion as well.

Further objects and advantages are to provide a stretching and strengthening exercise system for upper extremities which easily can be used to improve the natural spinal motion, which is easily attachable at the wall to provide additional shoulder motion and more strenuous exercises for upper extremities and spine, which can be used as a home exercise device for users, as well as a therapeutic device for professional use in physical therapy offices or fitness studios. Still further object and advantages will become obvious from a consideration of the ensuing description and drawings.

SUMMARY

In accordance with present invention an exercise apparatus for upper extremities comprises a base, a rotator means for being movable by a user through substantially 360 degrees, a handle means for being slideable and a oval means for repositioning of said handle means as said handle means being moved by a user, a wall means for allowing said base to be attached at a wall and allowing said base being slidable.

DRAWINGS

Figures

DRAWINGS

Reference Numbers

| | |
|---|---|
| 20 | base |
| 21 | track |
| 22 | top-cover |
| 23 | rotator |
| 24 | handle |
| 25 | top-handle |
| 26 | adjustment-knob |
| 27 | adjustment-knob |
| 28 | body |
| 29 | tongue |
| 30 | slide |
| 31 | slide |
| 32 | oval-stand |
| 33 | belt |
| 34 | washer |
| 35 | roller |
| 36 | spring |
| 37 | washer |
| 38 | spring |
| 39 | spring |
| 40 | rotator |
| 41 | neck |
| 42 | antifriction ball |
| 43 | upper surface |
| 44 | circular-cutout |
| 45 | shaft |
| 46 | adjustment-knob |
| 47 | bottom |
| 48 | frame |
| 49 | central-blade |
| 50 | hinge |
| 51 | hinge |
| 52 | bolt |
| 53 | base-hole |
| 54 | base-hole |
| 55 | mounting peg |
| 56 | mounting peg |
| 57 | circular stand |
| 58 | handle |

DETAILED DESCRIPTION

Preferred Embodiment

Figure 1:
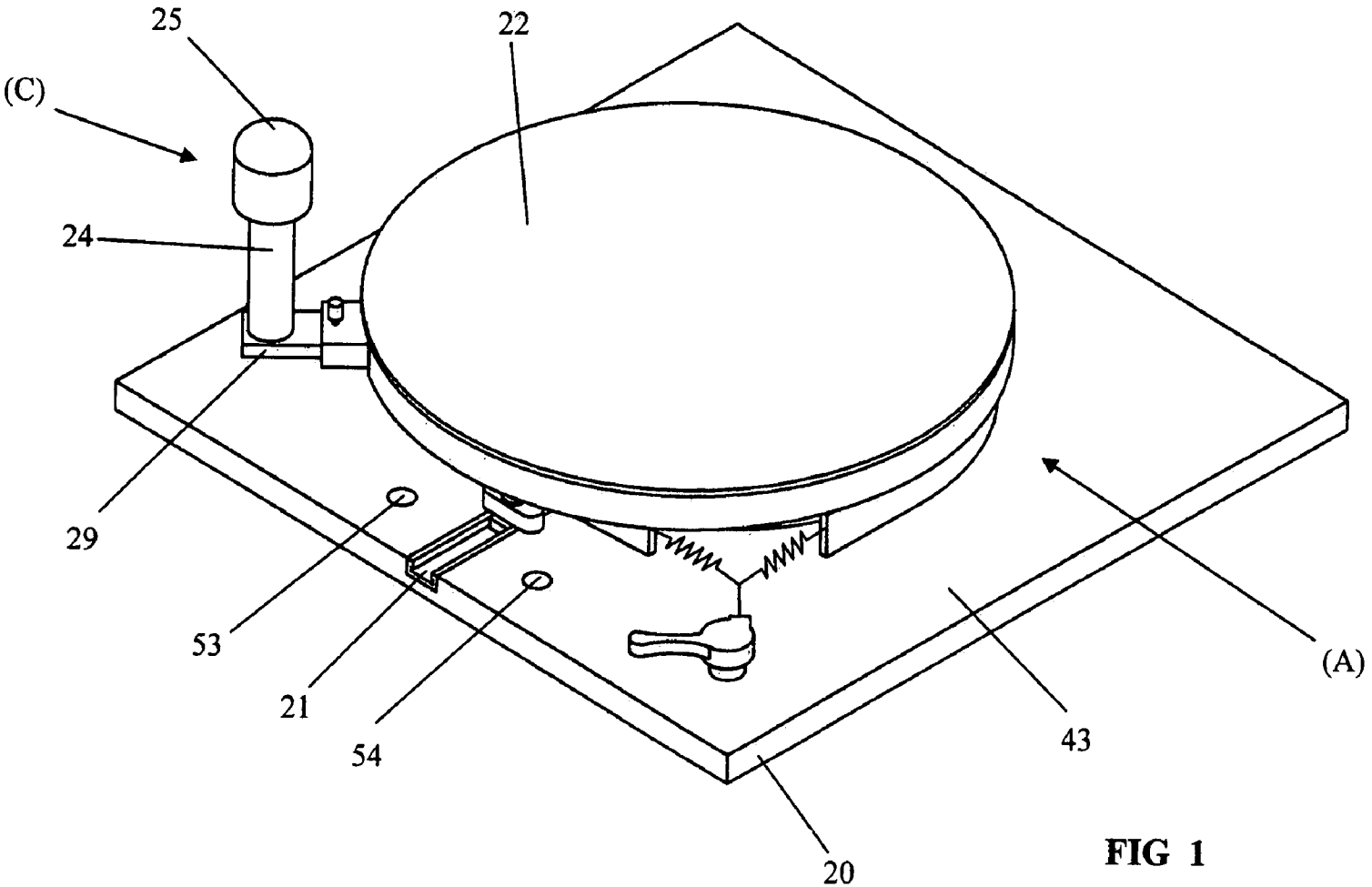
FIG. 1 shows a perspective view of the presented invention.

A preferred embodiment of the present invention is shown in FIG. 1. Referring to FIG. 1 preferred embodiment of the invention has a base 20, an upper surface 43, a top-cover 22, a track 21 for receiving an oval means B (not shown) respectively, to be described in further detail later herein is fixed to a groove that is carved approximately in the middle line of base 20, a rotator means A for being movable by a user through substantially 360 degrees, which may be rotated either clockwise or counterclockwise, is mounted on upper surface 43 of base 20, respectively, to be described in further detail later herein.

Furthermore, FIG. 1 shows a pair of base-holes 53 and 54, are used to receive a pair mounting pegs 55 and 56 (not shown), respectively, to be described in further detail later herein. Base 20 is consisting of any firm material such as wood, high density plastic, sturdy metal, composite material or the like that can be used to provide sufficient tensile strength and load bearing capability. Base 20 is in general square in shape for the preferred embodiment, but could be one of any number of geometric shapes.

Figure 3:
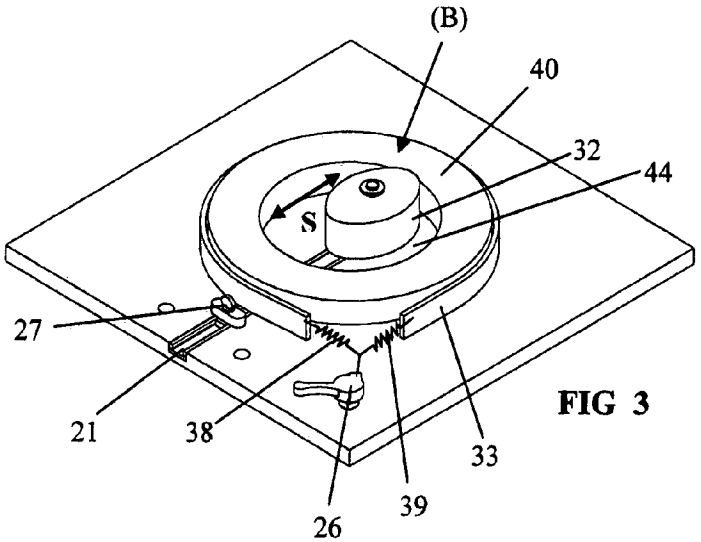
FIG. 3 shows a perspective view of the present invention without the rotator 23 and handle means.
Figure 4:
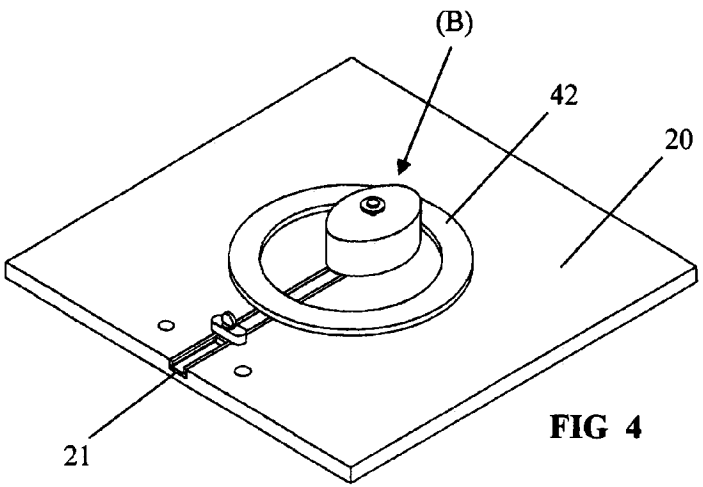
FIG. 4 shows a perspective view of the present invention without rotator 23 and 40, resistance means and handle means.
Figure 2:
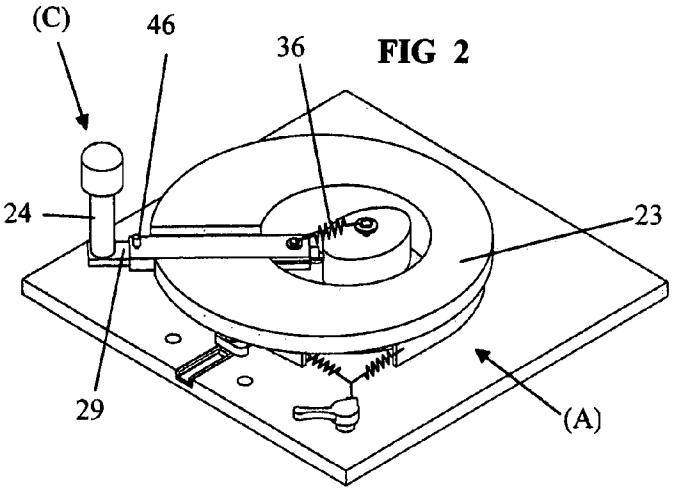
FIG. 2 shows a perspective view of the present invention without the top cover.

The rotator means A includes a rotator 23 as shown in FIG. 2, a rotator 40 as shown in FIG. 3, and an antifriction ball 42 as shown in FIG. 4. Rotator 23 is attached on to rotator 40, which is attached on to antifriction ball 42. Referring to FIG. 4 antifriction ball 42 is attached on to upper surface 43 of base 20. Rotator 23 and rotator 40 are in general circular in shape for the preferred embodiment, but could be one of any number of geometric shapes. As shown in FIGS. 3 and 4 a track 21 is fixed in the groove to receive an oval means B, respectively, to be described in further detail later herein.

Further aspect of the rotator means, is a friction device which includes a belt 33 wrapped around rotator 40, a pair of springs 38 and 39 witch are connecting belt 33 to a adjustment-knob 26, as shown in FIG. 3.

Figure 5:
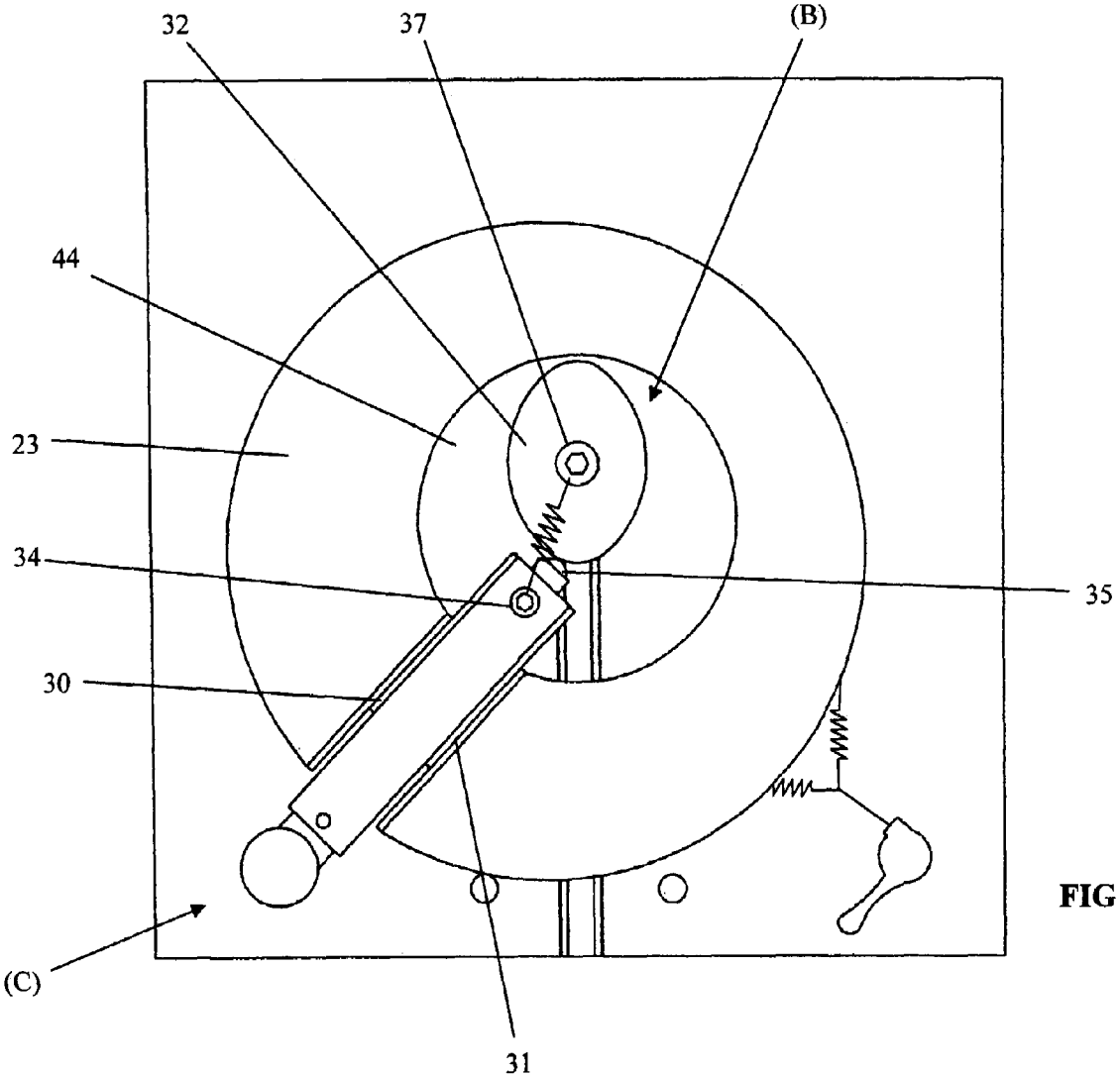
FIG. 5 shows a top view of the present invention without top cover.
Figure 6:
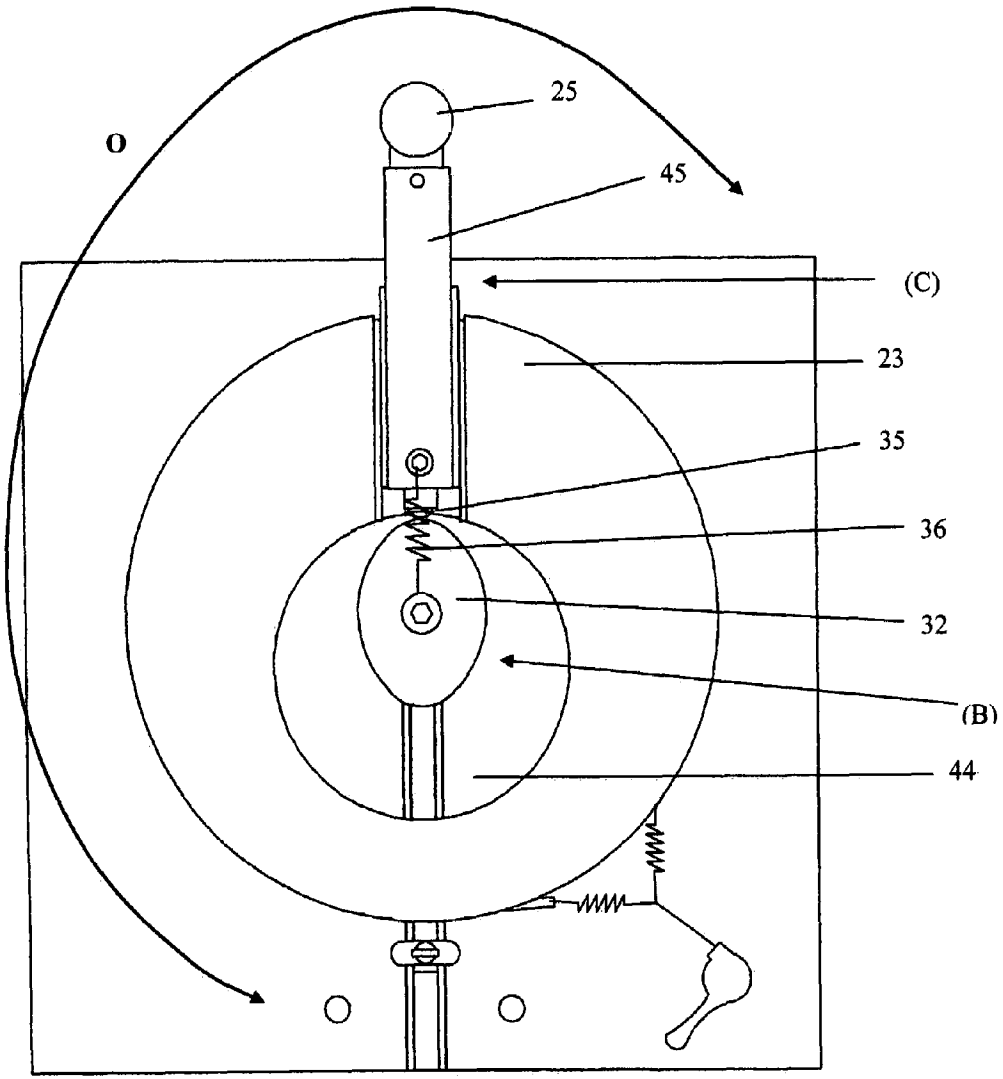
FIG. 6 shows a top view of the present invention while handle means has been slid out.

As shown in FIGS. 5 and 6 a handle means C is mounted in a gap in rotator 23, respectively, to be described in further detail later herein. A circular-cutout 44 is made approximately in the middle of rotator 23. Circular-cutout 44 is continued approximately through middle of rotator 40 (not shown). Circular-cutout 44 is to make space for the oval means B being slidable, respectively, to be described in further detail later herein.

Figure 7:
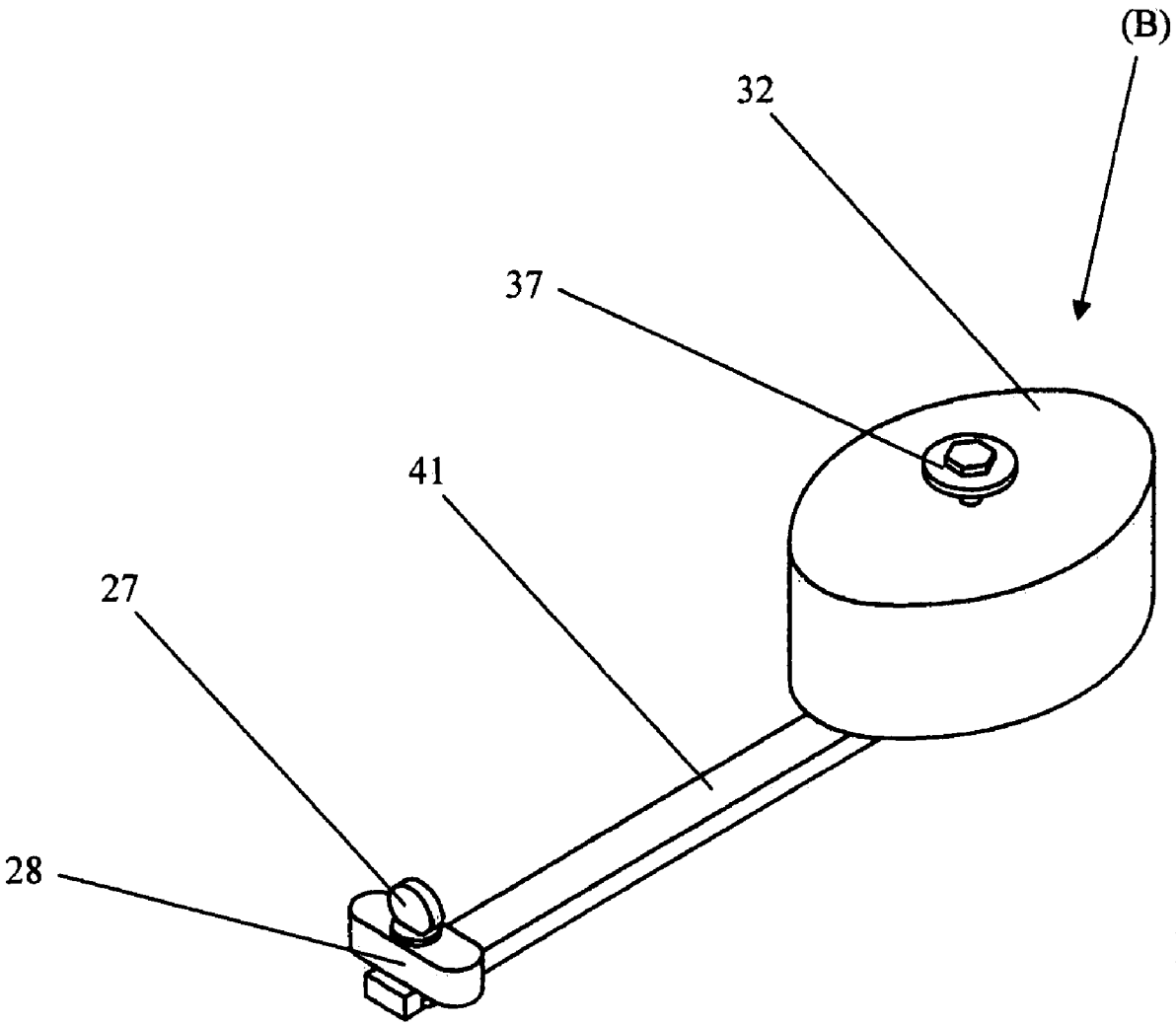
FIG. 7 shows a perspective view of the oval means.

FIG. 7 shows an oval means B for repositioning the handle means. The oval means is consisting of a neck 41, an oval-stand 32 which is attached to the distal end of neck 41, a washer 37 is mounted approximately in the middle of oval-stand 32 and is rotatable, an adjustment-knob 27 with a body 28 is mounted to the proximal end of neck 41. As shown in FIG. 3 oval-stand 32 is placed in circular-cutout 44 and is slidable. Slidability of oval-stand 32 is indicated by the arrow S. The oval means is movable and is placed in track 21.

Figure 8:
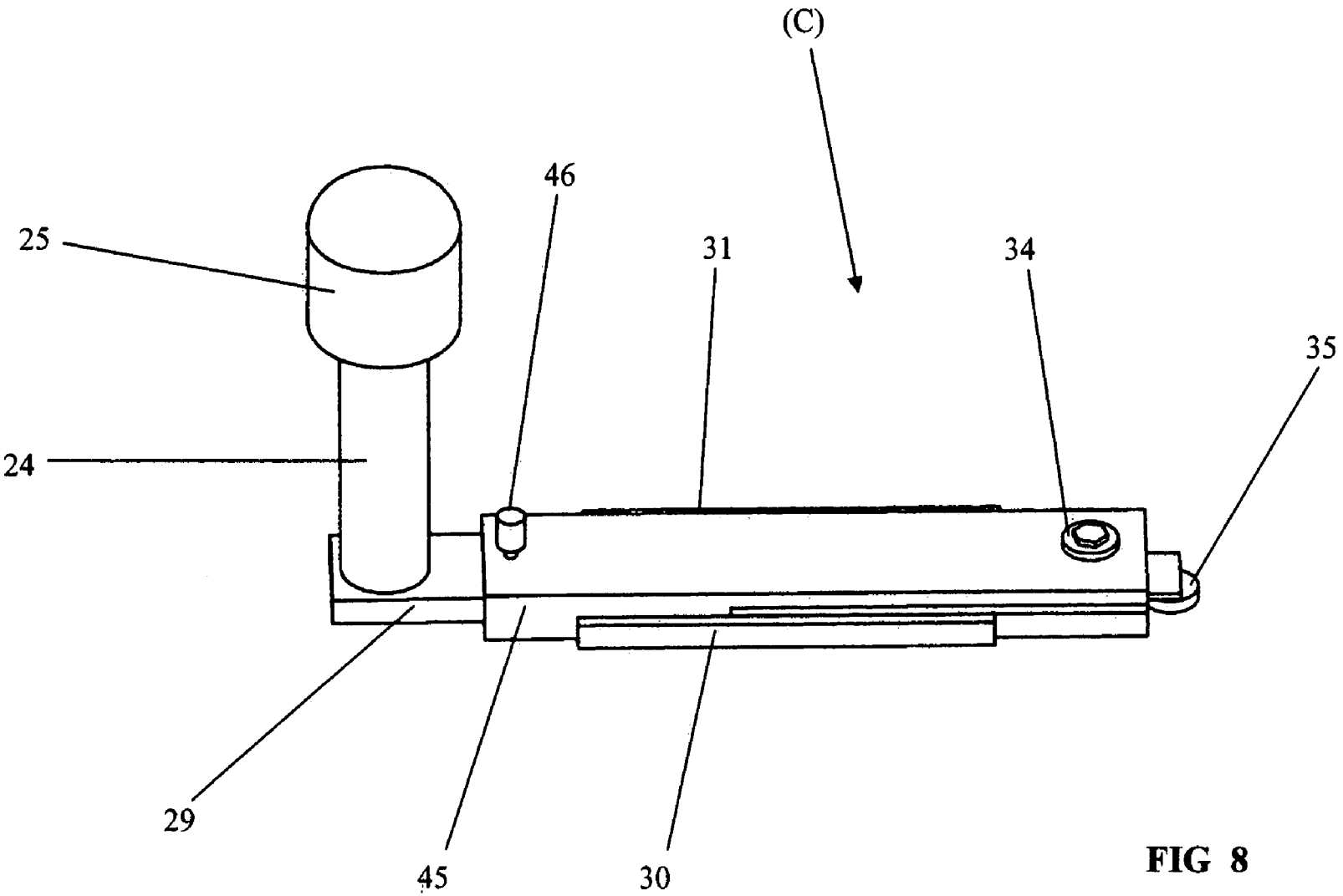
FIG. 8 shows a perspective view of the handle means.

FIG. 8 shows a handle means C for being slidable as the rotator means is being moved by a user in a circular motion. The handle means includes a hollow shaft 45, a pair of slide 30 and 31, a roller 35 which is attached to the distal end of shaft 45, a tongue 29 which is adjustable in its length is placed in shaft 45 and is stabilized through an adjustment-knob 46, a handle 24 and a top-handle 25 attached to the proximal end of tongue 29, a washer 34 is mounted to the distal end of shaft 45 and is rotatable.

Referring to FIG. 5 the handle means is mounted in the gap in rotator 23. Slide 30 and 31 are attached to shaft 45 and to rotator 23. A spring 36 is attached to washer 34 and washer 37. Washer 37 is mounted approximately in the middle of oval-stand 32. Roller 35 is contacting oval-stand 32.

Figure 9:
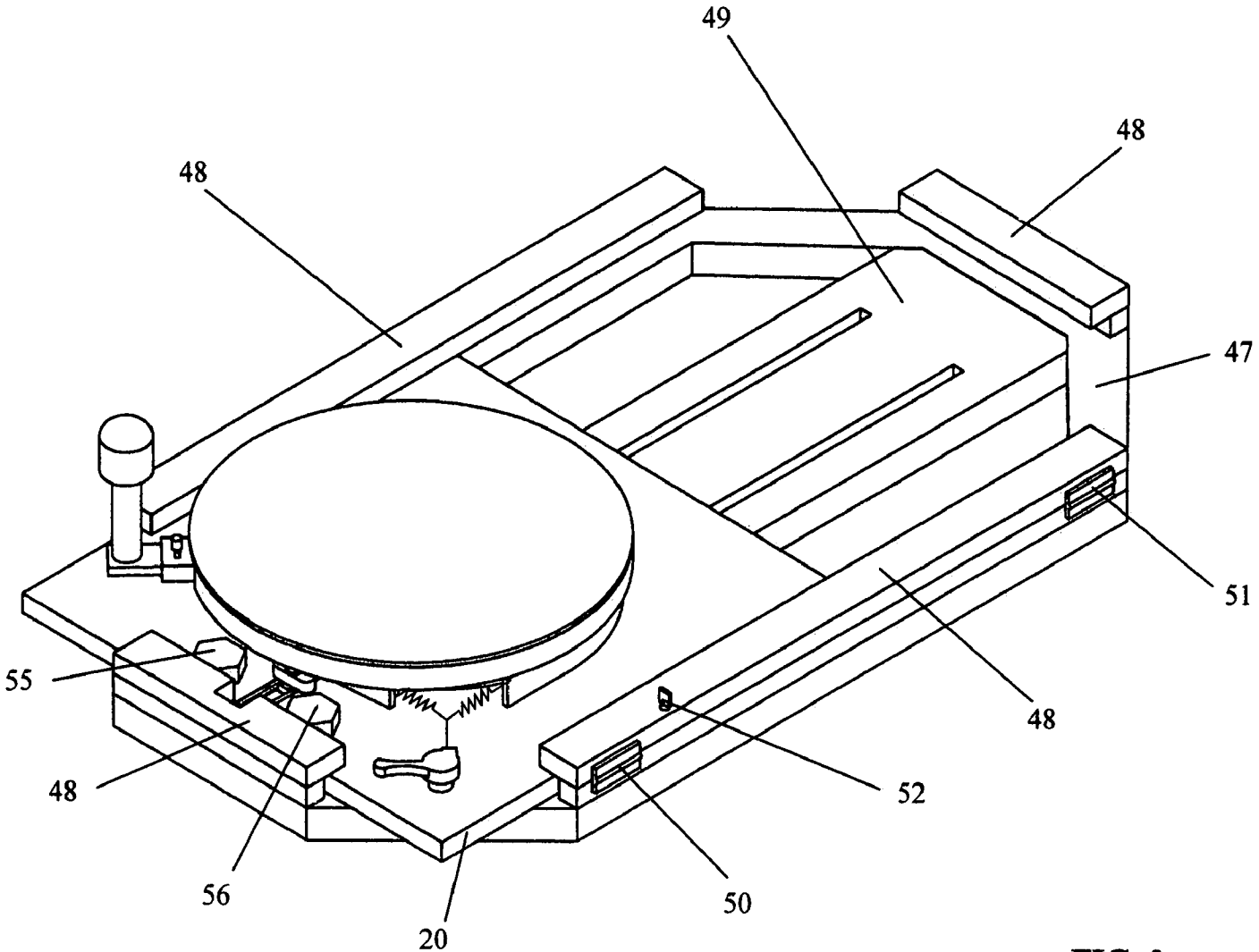
FIG. 9 shows a perspective view of the present invention with the wall means.

Further aspect of present invention, as shown in FIG. 9, is a wall means for placing and supporting base 20 and therefore the exercise apparatus in a vertical plan. The wall means includes a bottom 47, bottom 47 is in general octagon in shape with two side equally approximately 4 feet long and a central-blade 49 and the pair of mounting pegs 55 and 56 that stabilize base 20 to central blade 49, a frame 48 attached on to four sides of bottom 47 opposite to each other creating a slit for base 20 being slidable, about two hinges 50 and 51 or the like attached to the right and/or left hand side of frame 48, a bolt 52 is fixed on to that side of frame 48 that has hinges 50 and 51 attached.

Operation Preferred Embodiment

The basic operation of the exercise apparatus is as follows. Referring to FIG. 1, to use the preferred embodiment of the present invention, a user (not shown) places the exercise apparatus on a table (not shown). The user grasps handle 24 or top handle 25. The user then actively moves handle 24 in a circular rotation, which may be rotated either clockwise or counterclockwise.

Referring to FIG. 6, as the user is moving top-handle 25, roller 35 rolls around oval stand 32. As roller 35 reaches the most convexed curve of oval-stand 32, oval-stand 32 forces roller 35, therefore shaft 45 and top-handle 25 to slide out. As the user continues to rotate top-handle 25, roller 35 roles over the most convexed curve of oval-stand 32, so shaft 45 will be pulled back through spring 36 and will slide in again. Thereby top-handle 25 moves in an oval motion where it emphasizes the scapulothoracal motion in the shoulder complex. The arrow O in FIG. 6 indicates the oval rotation of the handle means.

The biceps, triceps and shoulder muscles may be exercised as the user pulls or pushes handle 24. Top-handle 25 gives the user further option to use the device with pronated forearm and creates additional exercise options. All seven natural spinal motions, such as flexion, extension, right and left lateral flexion, right and left rotation, and circular rotation can be exercises while the user is moving handle 24 or top-handle 25.

Referring to FIG. 2 as the user progresses and gains in shoulder, arm or spinal range of motion, the radius of the oval rotation of handle 24 can be increased. This may happen by loosening adjustment-knob 46 and increasing the length of tongue 29. Another way, as shown in FIG. 3 may be by loosening adjustment-knob 27 and sliding oval-stand 32 towards the end of circular-cutout 44. To increase the rotational frictional force as handle 24 is been rotating, belt 33 witch is wrapped around rotator 40 generate a braking force can be adjusted through adjustment-knob 26.

As shown in FIG. 9 the wall mans is for supporting the exercise apparatus in the vertical plane and therefore creating more variety of exercises for upper extremities and spine. The device can be placed in frame 48 and be secured with bolt 52. Pair of mounting pegs 55 and 56 fasten base 20 to central-blade 49. Based on users body size base 20 can be sliding up or down within frame 48 and be secured with mounting pegs 55 and 56.

Description Additional Embodiment

Figure 10:
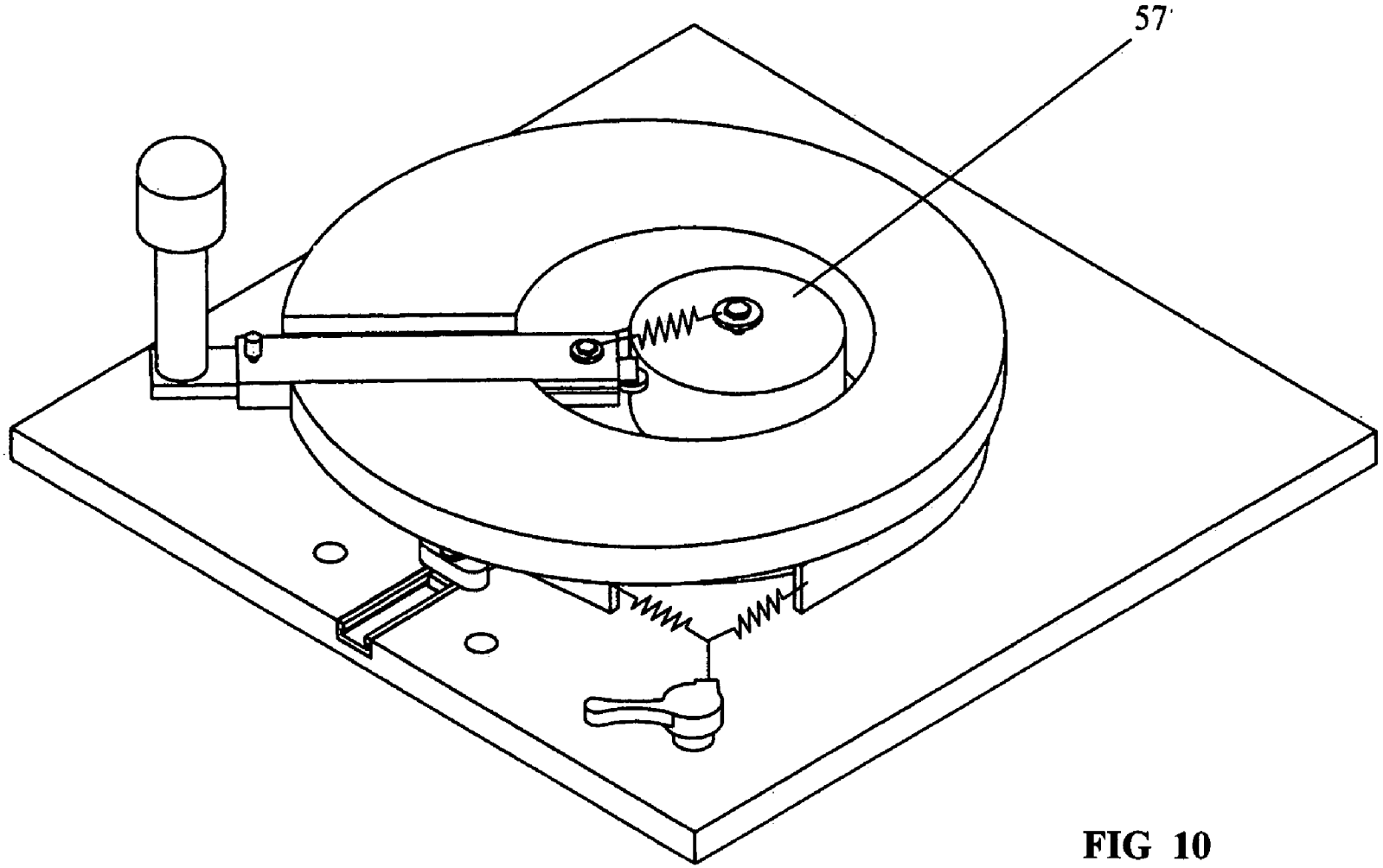
FIGS. 10, 11 and 12 show a perspective view of the present invention with additional embodiments.
Figure 11:
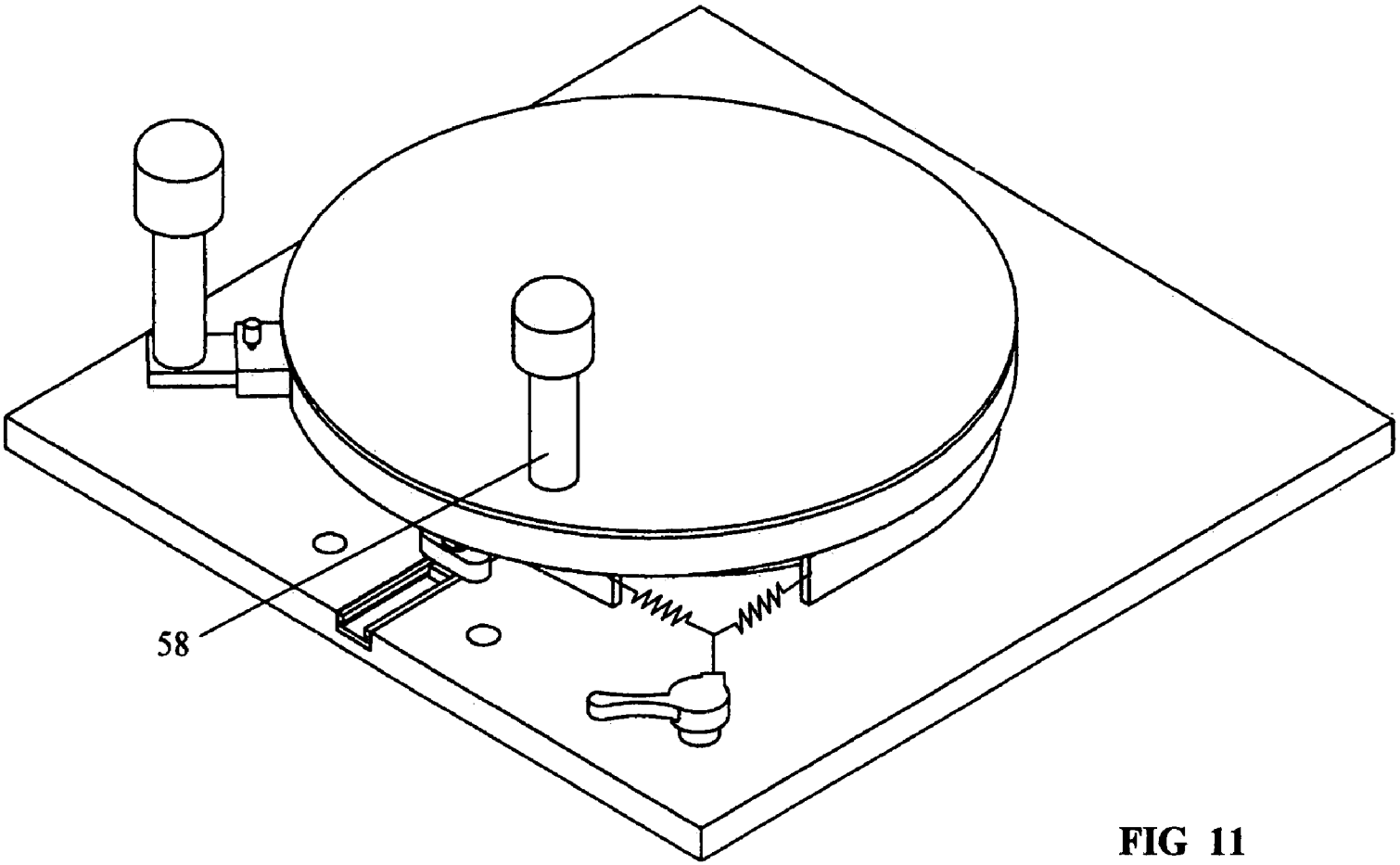
Figure 12:
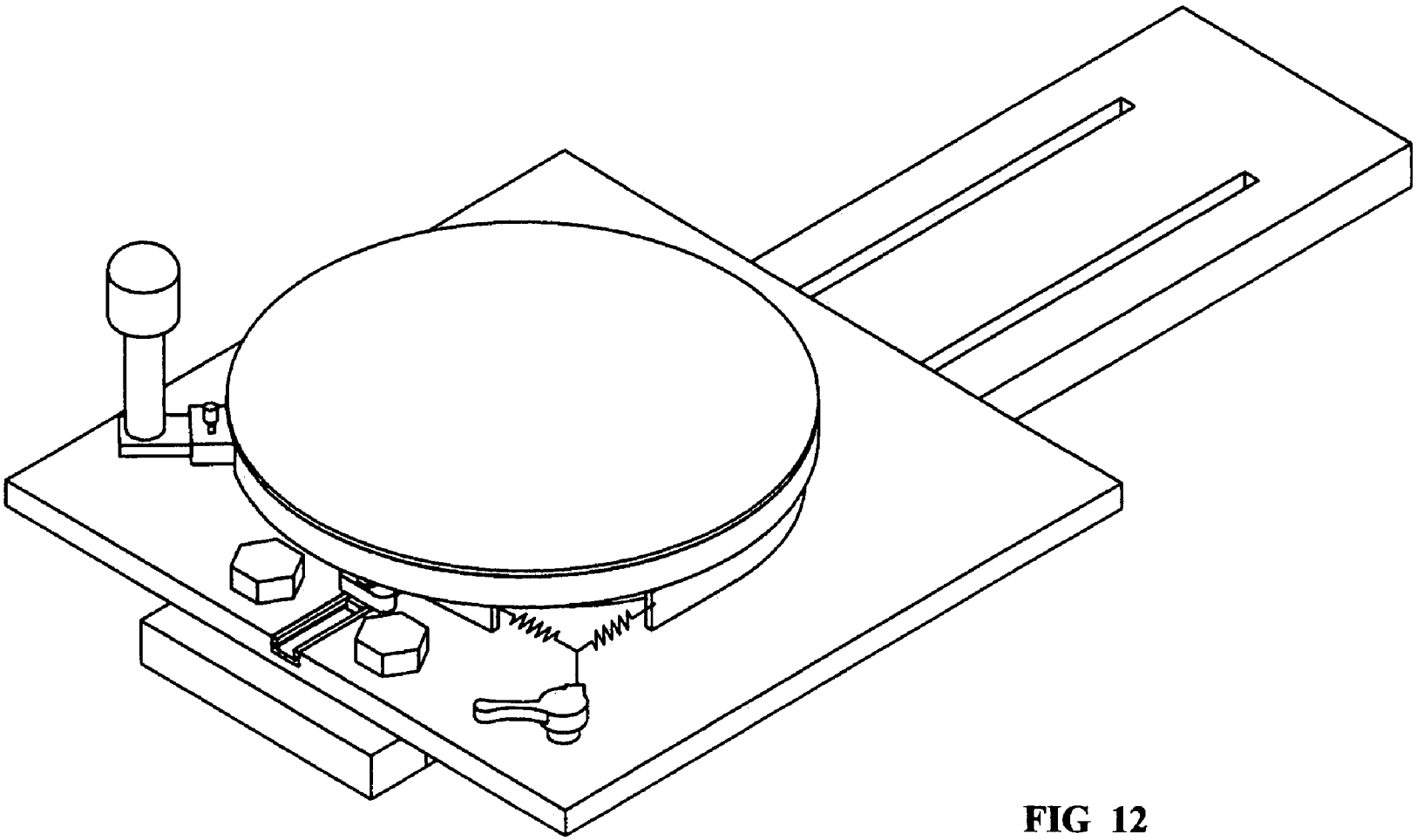

FIGS. 10, 11, and 12 show additional embodiments from a perspective view. FIG. 10 shows the exercise apparatus with a circular stand 57 as an alternative for the oval stand; FIG. 11 shows the exercise apparatus with additional handle 58 attached to the rotator means; FIG. 12 shows the wall means only with the central-blade.

Operation Additional Embodiment

Referring to FIG. 10, circular stand 57 can be used as an alternative to the oval stand. The operation the circular stand is as the same as the oval stand, except that the radius of the oval rotation is much less.

Referring to FIG. 11, one can grape additional handle 58 attached to the rotator means and exercise the upper extremities in circular rotation. The circular rotation may be rotated either clockwise or counterclockwise.

The main operation of the wall means in FIG. 12 remains the same as mentioned in operation preferred embodiment. The wall means in FIG. 12 is for stabilizing base 20 in a vertical plane on a wall. It allows the base to slide up or down based on the users body size.

CONCLUSION, RAMIFICATION, AND SCOPE

Accordingly, the reader will see that my present invention can be used to exercise the upper extremities, improve scapulothoracal motion and promote spinal motion, can be used in vertical, horizontal and sagittal plane to allow physiological motions in the joints, and can be used as an easy and convenient home exercise machine. Furthermore, the exercise apparatus has the additional advantages in that

- it provides a simple device and easy to use home exercise apparatus that does not require a continual professional assistant.
- it provides a cost effective exercise apparatus that is affordable.
- it provides a compact, light, and portable exercise apparatus that is easy to store if needed.
- it promotes the scapulothoracal motion with a unique system.
- it allows all three important shoulder motions frontal, horizontal, and sagittal.
- it provides a simple resistance adjustability.
- it is adjustable to any body size and level of condition.
- it allows users with additional muscle or joint problems in upper or lower extremities and spine to benefit from it.
- it promotes spinal motion.
- it is accessible for everyone.

Although the description above contains many specificities of the present invention, it is to be understood that these should not limit the scope of the invention but as merely provide illustrations of some of the presently preferred embodiment of this invention.

For example, the base, the rotators, the handles and the wall means can be made of any firm materials, such as wood, high density plastic, sturdy metal, composite material or the like that can be used to provide sufficient tensile strength and load bearing capability; the base and the wall means can have any size and one of number of geometric shapes, such as circular, oval, square, trapezoidal, ect.

The rotators can be made of the same or different material than the base; the rotators can have any size and one of number of geometric shapes, such as circular, oval, square, trapezoidal, ect.; the handles can have any size and any shape, such as straight, curve, sphere, oval, ect.; the shaft and the tongue can be one piece without an adjustment knob.

Although the invention has been described in connection with the preferred embodiment or embodiments thereof, it is to be understood that the invention is not limited to such embodiments. Thus the scope of the invention should be determined by the appended claims and other legal equivalents, rather than by the examples given or other suitable modifications, variations, and equivalents.

What is clamed is:

1. An exercise apparatus movable by a user in an oval motion in a plurality of mutually diverse planes to exercise the user's upper extremities and all associated muscle groups and body parts, as well as exercising the trunk and spine, comprising in combination: a base having an upper surface, a rotator means, said rotator means for being movable by a user through substantially 360 degrees, said rotator means being mounted on said upper surface of said base and having a slot thereon, a handle means, a slide positionable in said slot, a tongue positioned inside said slide, an oval means positioned inside said rotator means, said oval means having a neck attached thereto, a track having a groove mounted on said base, said tongue attached to said handle means and said oval means, said tongue being slideable through said slide when moved by said handle means, said handle means being rotatable by a user through substantially 360 degrees, said handle means attached to said oval means, for repositioning of said handle means as said handle means is being moved by a user, said oval means being mounted on said track, whereby said handle means will slide out, guided by said oval means while said handle means is being rotated by a user.

2. Apparatus as in claim 1, further comprising a wall means for allowing the exercise apparatus to be attached to a wall in a vertical plane; a bottom, said bottom being fixedly mountable at a wall, a frame, said frame supporting the edges of the exercise apparatus in a vertical plane, a central-blade, said central-blade being fixedly mountable to a wall and to said bottom, said central-blade supporting the exercise apparatus in a vertical plain, whereby said frame and said central-blade support said exercise apparatus in a vertical plain to allow a variety of exercises.

* * * * *